United States Patent [19]

Fujikake et al.

[11] 4,073,338

[45] Feb. 14, 1978

[54] HEAT EXCHANGERS

[75] Inventors: Kenji Fujikake; Isamu Amaki; Masatoshi Suzuki, all of Nagoya, Japan

[73] Assignee: Toyota Chuo Kenkyusho, Nagoya, Japan

[21] Appl. No.: 709,174

[22] Filed: July 27, 1976

Related U.S. Application Data

[63] Continuation of Ser. No. 482,464, June 24, 1974, abandoned.

[30] Foreign Application Priority Data

June 26, 1973 Japan ..... 48-72429

[51] Int. Cl.[2] ..... F28D 11/60; A01F 12/44

[52] U.S. Cl. ..... 165/86; 62/499; 415/54; 415/148

[58] Field of Search ..... 415/54, 184, 219 C; 416/181, 178, 186, 187; 165/86–90, 122; 62/499

[56] References Cited

U.S. PATENT DOCUMENTS

| | | | |
|---|---|---|---|
| 2,169,601 | 8/1939 | Cornelius et al. | 165/90 |
| 3,253,649 | 5/1966 | Laing | 165/86 |
| 3,295,597 | 1/1967 | Laing et al. | 165/86 |
| 3,347,059 | 10/1967 | Laing | 62/499 |
| 3,424,234 | 1/1969 | Laing | 165/89 |
| 3,813,184 | 5/1974 | Temple | 415/54 |
| 3,828,531 | 8/1974 | Quick | 56/12.9 |
| 3,833,006 | 9/1974 | Temple | 415/54 X |

FOREIGN PATENT DOCUMENTS

| | | | |
|---|---|---|---|
| 383,594 | 11/1932 | United Kingdom | 416/181 |

*Primary Examiner*—Charles J. Myhre
*Assistant Examiner*—Theophil W. Streule, Jr.
*Attorney, Agent, or Firm*—Koda and Androlia

[57] ABSTRACT

A heat exchanger is equipped with a cross flow fan. The rotor of the cross flow fan is composed of annularly arranged air-blowing blades and annular passage members intersecting said air-blowing blades and arranged at suitable intervals in the axial direction. A working fluid is distributed to flow through said annular passages for thereby exchanging heat with another working fluid which is caused to flow by the rotor.

32 Claims, 17 Drawing Figures

HEAT EXCHANGERS

This is a continuation of application Ser. No. 482,464, filed June 24, 1974 now abandoned.

BACKGROUND OF THE INVENTION

Field of the Invention

This invention relates to a rotary heat exchanger provided with an annular rotor which is rotatable to cause one of two working fluids to flow through the interior of annular members of the rotor and to flow the other working fluid diametrically through the rotor for heat exchanging.

Prior Art

Conventional heat exchangers designed to exchange heat between two working fluids such as a gas and liquid are provided with a fan and a propeller pump adapted to flow the gas and liquid, respectively, so that the heat exchangers become voluminous. Besides, the fan and propeller pump require separate drive units so that the manufacturing cost of these heat exchangers becomes expensive.

When a rectangular type of heat exchanger such as a radiator and propeller fan such as cooling fan are used in combination, a satisfactory ventillation cannot be attained at corners of rectangular heat exchanger because the propeller fan provides a ventillation action only in a circular area. Also, the propeller fan cannot provide an air velocity which is evenly distributed over every radial direction: but it provides an air velocity which is much smaller in the peripheral and central areas, thereby lowering the efficiency of the heat exchanger.

To eliminate these disadvantages it is already known to apply a rotary annular rotor such as a cross-flow fan to the heat exchanger. Within each blade of the rotor is formed a passage for one working fluid so that the working fluid can flow inside the blade for exchanging heat with the other working fluid flowing outside of the rotor. According to this heat exchanger the fluid passage is formed within the blades arranged parallel to the axis of rotor and fins are attached to the rotor perpendicularly to the blades and, accordingly, to the axis of rotor for thereby obtaining a large heat transfer area. With this construction, however, in order to flow a large flow rate of fluid through the inside of blades, it is necessary to increase the number and/or cross sectional area of the blades. These are important factors having a large influence over the performance of the fan. However, the increase of the number and/or cross sectional area of the blades makes the manufacture of such heat exchanger difficult and is not desirable for making the heat exchanger compact. Besides, in this type of heat exchanger, the fins serve exclusively to provide heat transfer surfaces but lower the flow rate of fluid therethrough.

SUMMARY OF THE INVENTION

It is therefore an object of this invention to provide a heat exchanger wherein the working fluids can be caused to flow efficiently to attain an efficient heat exchange.

Another object of this invention is to provide a heat exchanger wherein two working fluids can be caused to flow efficiently by use of a single drive unit.

Still another object of this invention is to provide a compact heat exchanger with simple construction at a low cost which can be adapted in such operation conditions where the heat exchanging quantity and/or working fluid volume vary over a relatively wide range.

For the purpose of attaining the above objects, according to the present invention, the heat exchanger having a rotor for generating a stream of a first working fluid and for effecting a heat exchange between said first working fluid passing over the blades of the rotor and a second working fluid, said rotor being rotatably supported in said stream of first working fluid and comprising a plurality of hollow annular passage means coaxially disposed in planes extending perpendicularly to the rotor axis and spaced in a predetermined interval therealong, a plurality of blades secured to said annular passage means and positioned coaxially with respect to said rotor to form blade portions extending parallel to the longitudinal axis of the rotor, at least one distribution-suction passage means having a first opening at one end thereof and at least one concentration-delivery passage means having a second opening at one end thereof which are secured together to said annular passage means and positioned in the relation opposite to each other with respect to the axis of said rotor, and intercommunicate said hollow annular passage means to form a system of internal ducts in said rotor, and port means connected to said openings of said distribution-suction passage means and said concentration-delivery passage means for sucking said second working fluid thereinto and delivering said second working fluid therefrom through said each openings thereof.

DESCRIPTION OF THE PRESENT PREFERRED EMBODIMENTS

Figure 1:
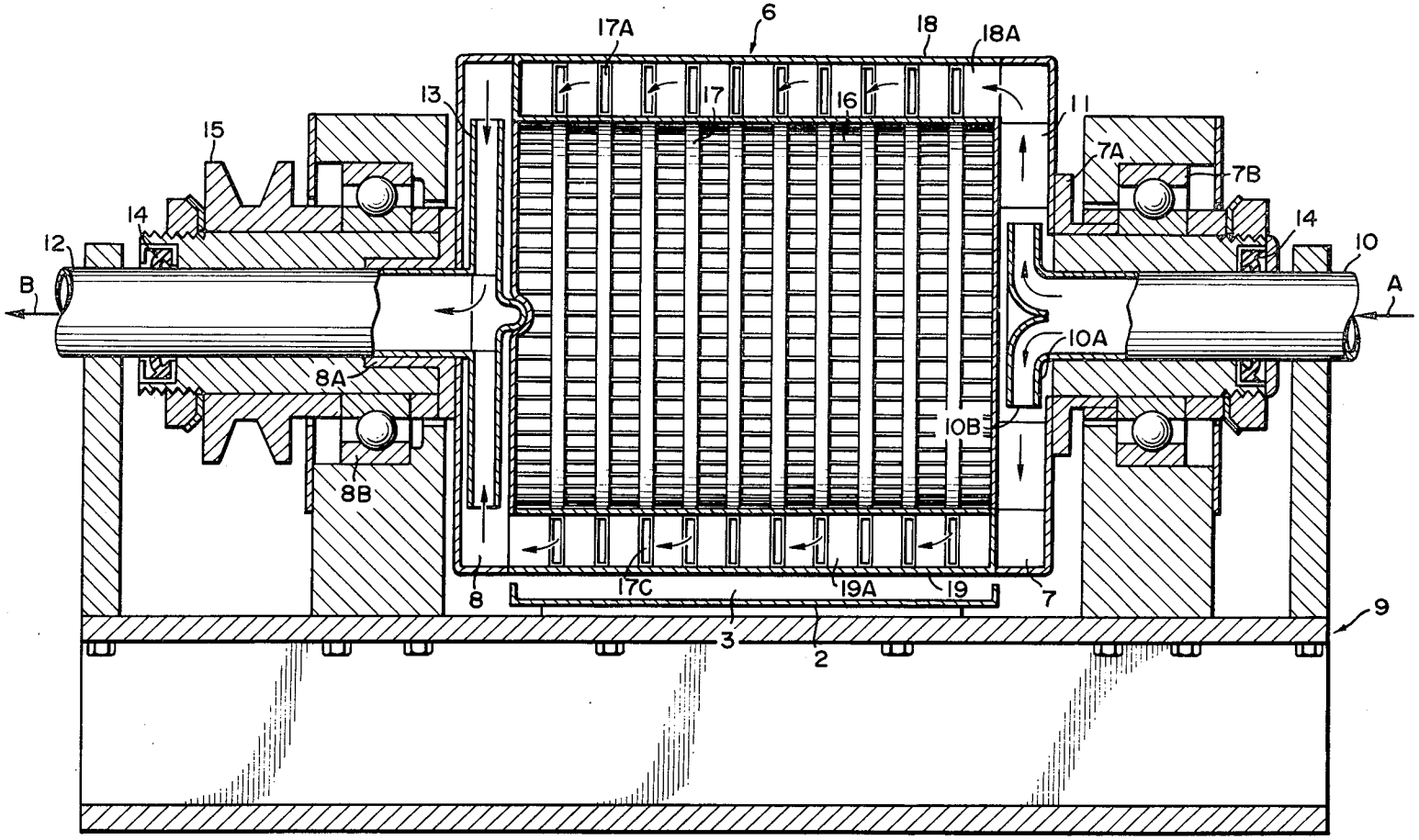
FIG. 1 is a schematic overall sectional view of the heat exchanger according to one embodiment of this invention.
Figure 2:
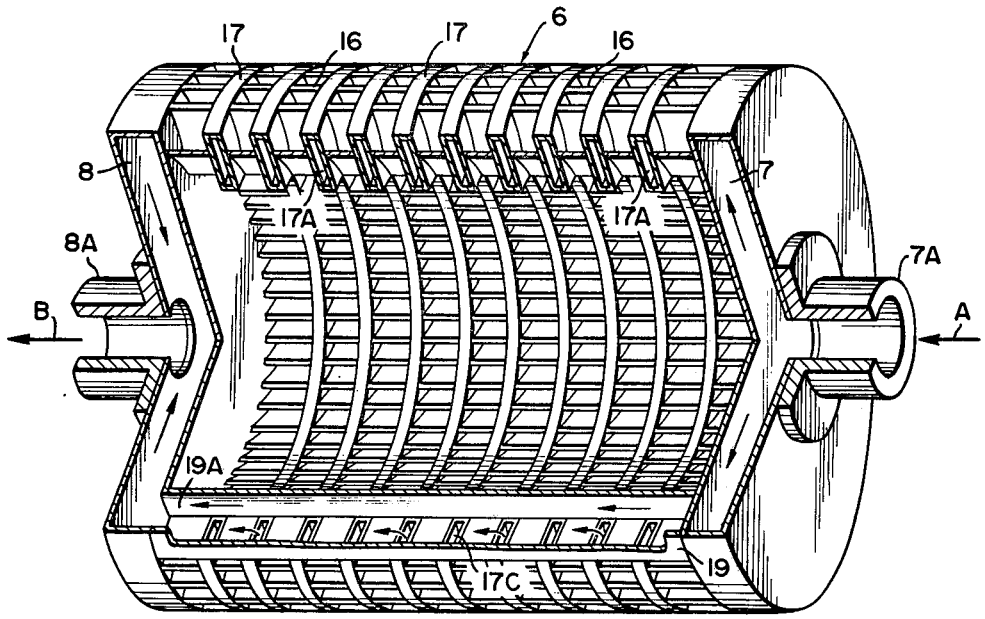
FIG. 2 and 3 are detailed perspective views of the rotor of FIG. 1.
Figure 3:
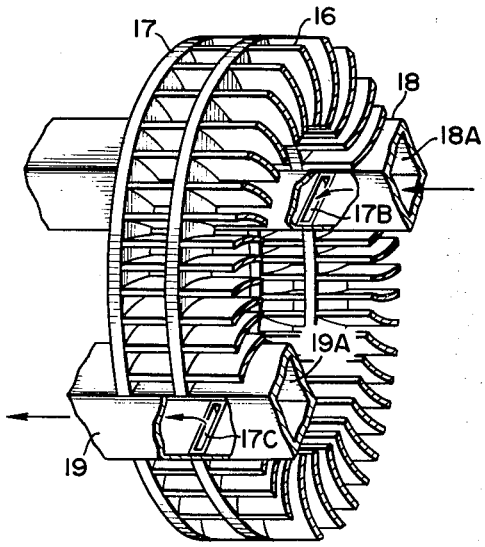

Illustrated in FIG. 1 is a schematic sectional view of the entire heat exchanger according to one embodiment of this invention. The heat exchanger is provided with a pair of casings 1 and 2. (FIG. 1 shows the casing 2 only. Also refer to FIGS. 6 and 7.) Between these casings 1 and 2 is defined a passage 3 for the first working fluid and at the opposite ends thereof are defined a suction port 4 and delivery port 5.

Within the passage 3 is arranged a rotor 6 thereacross and at the opposite axial ends of said rotor are formed hollow cylindrical pumping chambers 7 and 8. In the outer-end walls of these pumping chambers 7 and 8 are centrally attached rotary pipes 7A and 8A, respectively, which are rotatably supported in bearings 7B and 8B so that the rotor 6 can rotate concentrically with these rotary pipes 7A and 8A.

A stationary pipe 10 fixed on a support 9 is inserted coaxially into the rotary pipe 7A so that they can rotate relative to each other. The stationary pipe 10 has one end projected into the pumping chamber 7 and connected at this end with a plurality of suction-distribution passages 10A extending radially and perpendicularly to the axis of stationary pipe 10. Each of said suction-distribution passages 10A has an outlet port 10B opening into the pumping chamber 7 in the radial direction.

Within the pumping chamber 7 is arranged a blade 11 which has a straight or arcuate cross section for radially flowing the fluid. The blade 11 is arranged concentrally with the suction-distribution passages 10A in such a position as to introduce the fluid from port 10B radially.

A stationary pipe 12 fixed on the support 9 is coaxially inserted into the rotary pipe 8A. The stationary pipe 12 has one end which is projected into the pumping chamber 8 and, within this pumping chamber 8, integrally supporting an outlet guide 13 arranged in a plane extending perpendicular to the axis of stationary pipe 12 (see FIG. 4*b*).

Indicated at 14 are seals preventing the leakage of fluid between the rotary pipe 7A and stationary pipe 10 and between the rotary pipe 8A and stationary pipe 12. A belt pulley 15 is fixedly mounted on the rotary pipe 8A by means of key or other suitable means (not shown) so that they are integrally rotatable together. The belt pulley 15 is driven by a drive unit (not shown) by means a belt (not shown) so that the rotor 6 rotates together with the rotary pipes 7A and 8A and the fluid propelling blade 11.

The rotor 6 is composed of a number of air-blowing blades 16 and a number of hollow annular passage members 17. The air-blowing blades 16 each being curved inwardly in the direction of rotation, are arranged around and parallel to the axis of rotor 6 into an annular configuration. The annular passage members 17, each being a hollow annular member arranged coaxial with and perpendicular to the axis of rotor 6, are arranged at constant intervals in the axial direction. Said air-blowing blades 16 and annular passage members 17 are integrally connected to each other by welding or other suitable connecting means so that they form an integral structure of cylindrical configuration.

The rotor 6 is also provided with a distribution-suction passage member 18 and a concentration delivery passage member 19, both extending from pumping chamber 7 to pumping chamber 8 in the same circumferential surface of the rotor 6 and parallel to the axis thereof and also intersecting each annular passage member 17 at right angles. These members 18 and 19 are symmetrically arranged with respect to the axis of rotor 6. They are hollow members including therein a distribution-suction passage 18A and concentration-delivery passage 19A, respectively.

The distribution-suction passage 18A is closed at one end on the side of pumping chamber 8 and communicated into the pumping chamber 7 at the other end; whereas the concentration-delivery passage 19A is closed at one end on the side of pumping chamber 7 and communicated into the pumping chamber 8 at the other end. These passages 18A and 19A are both in communication with the annular passage 17A in each annular passage member 17 by way of openings 17B and 17C, respectively, which are defined at positions where the passage members 18 and 19 intersect with annular passage members 17. Thus, the pumping chamber 7 is communicated with the pumping chamber 8 by way of the distribution-suction passage 18A, opening 17B, annular passage 17A, opening 17C and concentration-distribution passage 19A.

Now the flowing of working fluid through the above-described heat exchanger will be described. The second working fluid introduced into the stationary pipe 10 in the direction of arrow A passes through the suction-distribution passage 10A and enters the pumping chamber 7 at the outlet port 10B. Within the pumping chamber 7 is applied a pressing action to the second working fluid outwardly due to the centrifugal force by the fluid propelling blade 11 which rotates integral with the rotor 6.

The second working fluid which has been applied a pumping action flows out of the pumping chamber 7 into the distribution-suction passage 18 and thence passes through openings 17B, annular passage 17A and openings 17C into the concentration-delivery passage 19A to the pumping chamber 8.

On the other hand, the first working fluid is sucked at the suction port 4 by the action of air-blowing blade 16, caused to flow within the passage 3 diametrically passing through the rotor 6 and delivered out of the delivery port 5. At a time when the first working fluid travels diametrically through the rotor 6 and the second working fluid passes through the annular passages 17A, a heat exchange is effected between the first and second working fluids by means of the annular passage members 17 and air-blowing blades 16.

The second working fluid admitted into the concentration-delivery passage 19A enters the pumping chamber 8. The pumping chamber 8 is integrally rotating together with the rotor 6 and the fluid on the side of outer circumference has a higher pressure than that within the stationary outlet guide 13 arranged in the inner circumference, so that the fluid is forced to flow due to this pressure difference, from the outer circumferential position to the center position of the outlet guide 13 and then delivered in the direction of arrow B passing through the stationary pipe 12.

Figure 4A:
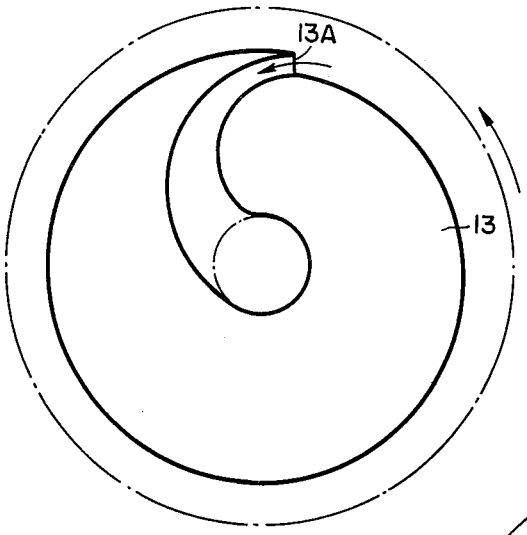
FIGS. 4*a* to 4*c* are schematic views illustrating some examples for the configuration of outlet guide.
Figure 4B:
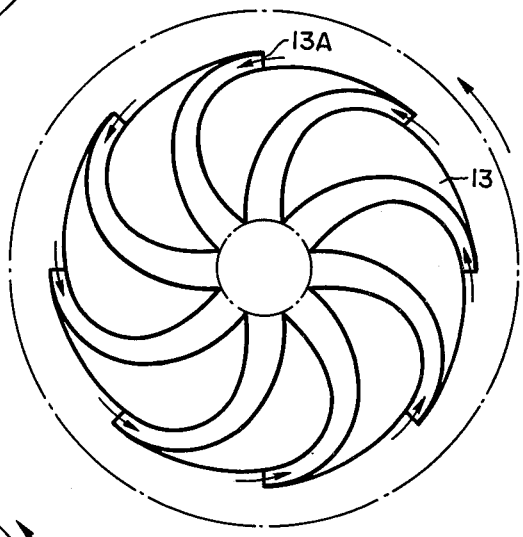
Figure 4C:
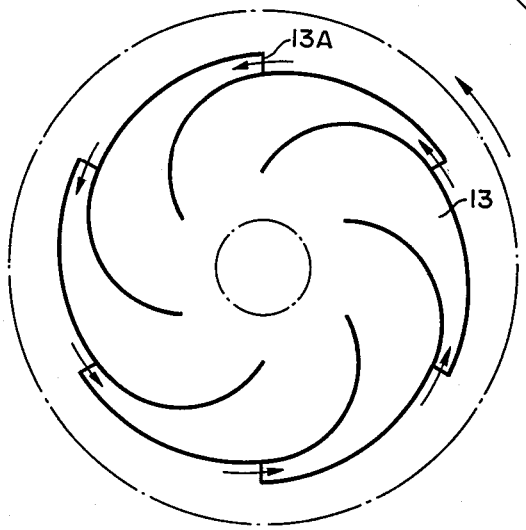

The fluid propelling blade 11 is preferably so shaped as to elevate the fluid pressure in the rotor 6 without a loss. For this purpose, the blade 11 may be so designed as to have a suitably curved or arcuate cross section or, otherwise, it may be a straight blade. In contrast with this, the outlet guide 13 is preferably so shaped as to flow the fluid smoothly therethrough without accompanying any sudden change in direction and speed of fluid flow. Experiments showed that the configuration of outlet guide 13 had an extremely large influence over the pumping action which is caused by the rotation of rotor 6. Illustrated in FIGS. 4*a*, 4*b* and 4*c* are examples of outlet guide used in the experiments. The results of experiments showed that the configuration of FIG. 4*b* provided a highest efficiency and the configurations of FIGS. 4*c* and 4*a* had increasingly lower efficiencies in this order. This means that the efficiency lowers as the number of inlet ports 13A of the outlet guide 13 decreases. These inlet ports 13A open in the tangential direction of fluid rotation which occurs as rotor 6 rotates and are so shaped as to guide the fluid smoothly toward the center of outlet guide 13 at a minimum resistance.

Figure 5:
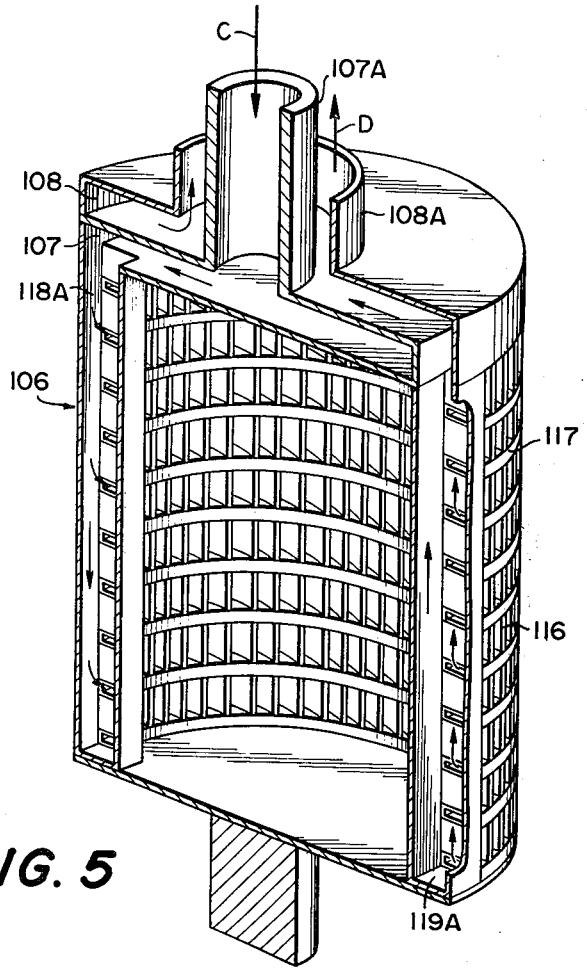
FIG. 5 is a perspective view of the rotor according to another embodiment of this invention.

The rotor may also be so constructed that pumping chambers are provided at one common end thereof (FIG. 5). More specifically, in this latter case the rotor 106 may be so constructed that the fluid flows out of the pumping chamber 107 into the adjacent pumping chamber 108 by way of the distribution-suction passage member 118A, annular passage members 117A and concentration-delivery passage member 119A. Thus, the rotor 106 provides a pumping action, and sucks the fluid in the direction of arrow C and delivers it in the direction of arrow D. In a similar manner to the first embodiment, a rotary fluid propelling blade and stationary outlet guide are arranged within the pumping chamber 107 and 108, respectively.

Figure 6:
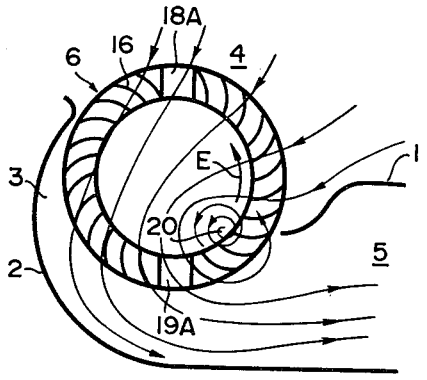
FIGS. 6 and 7 are schematic views representing stream lines of the fluid flowing through the heat exchanger of this invention.
Figure 7:
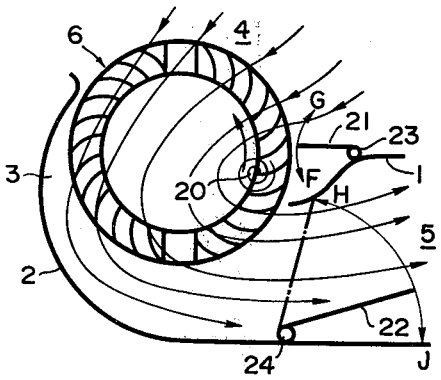

How the air-blowing mechanism for use in the heat exchanger of this invention will be described hereinunder. FIG. 6 is a schematic end view of the rotor 6. The fluid (in this drawing, gas) produced by the combination of rotating rotor 6 and fixed casings 1 and 2, is represented by stream lines. As viewed in FIG. 6, the rotor 6 rotates counter-clockwise or in the direction of arrow E. The air-blowing blades 16 are inwardly curved in the direction of rotation are mentioned previously. When the rotor 6 rotates, a so-called Rankine's vortex 20 having its center located on the inner circumference of rotor 6 in a position close to the casing 1 will be formed. The gas induced by said vortex then flows through the passage 3 defined between the casings 1 and 2 and is delivered out of the delivery port 5. Such a construction is already known as a cross flow fan and will not be detailed herein. It is known, however, that the air-flowing characteristic is largely influenced by the configuration of casings 1 and 2. The invention intends to provide a heat exchanger designed to be used within a range of relatively low flow resistance, so that the heat exchanger of this invention will have an increasingly larger heat exchanging efficiency as the quantity of air flow rate increases in this range.

By the way, to maintain the temperature of fluid delivered from casing at a constant level by adjusting the heat exchanging rate, the heat exchanger must be so designed at to allow the adjustment of air-flow rate. For this purpose, the heat exchanger of this invention is provided with an air flow rate increasing plate 21 and a throttle plate 22. The air flow rate increasing plate 21 is arranged in the passage 3 so that it is pivotable on a shaft 23 (which is arranged in a position close to the suction port 4 and in adjacent to the casing 1) from position F to G to thereby control the position of Rankine's vortex. The throttle plate 22 is arranged in a position close to the outlet port 5 so that it is pivotable on a shaft 24 (which is arranged in an adjacent position to the casing 2) from position J to H to thereby gradually reduced the air-flowing rate down to zero.

Figure 8:
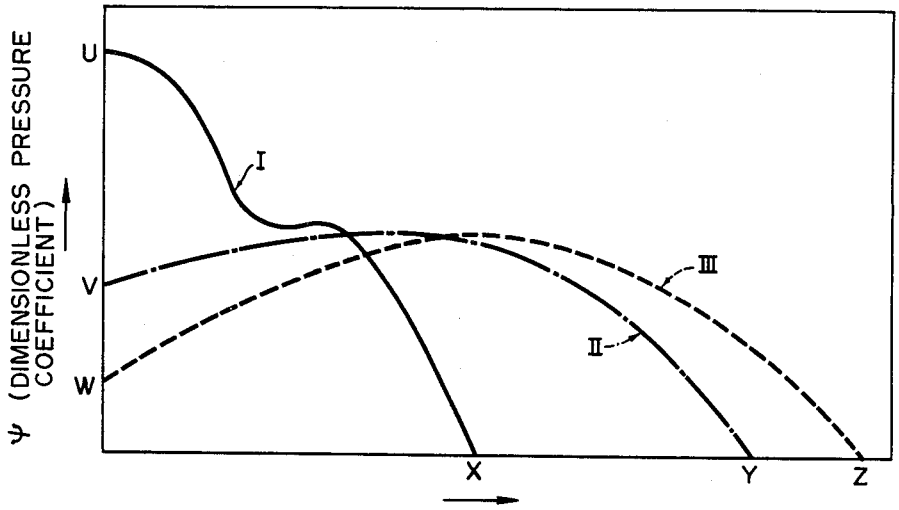
FIGS. 8, 9 and 10 are graphs representing air-blowing characteristic curves obtained from the heat exchanger of FIG. 7.
Figure 9:
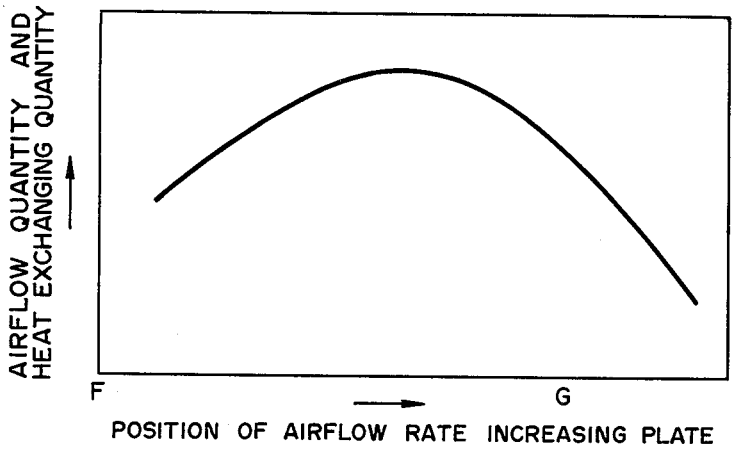

The inventors experimentally found that when the airflow rate increasing plate 21 was swung from position F to G with the throttle plate 22 being set to the position J to open the outlet port 5 completely, the air-flowing characteristic gradually changed as shown in FIG. 8 by curves I, II and III in this order. In this experiment, a two-arc joint type casing 1 and a logarithmic spiral type casing 2 were arranged in association with the rotor 6 so that the suction port had an aperture angle of 180° and the delivery port had an aperture angle of 180°. In the graph of FIG. 8, a dimensionless flow coefficient is taken on the abscissa and the dimensionless pressure coefficient is taken on the ordinate. The point X represents the airflow at a time when the airflow rate increasing plate 21 is in the position F; whereas the points Y and Z represent the airflows at the time when the airflow rate increasing plate 21 is swung gradually closer to the position G. The curve of FIG. 9 represents the relation between the position of airflow rate increasing plate 21 and the heat exchanging airflow at that time in full open condition of the throttle plater 22 when rotation of the rotor is constant. In this graph, reference characters F and G correspond to the positions F and G in FIGS. 7. On the other hand, when the throttle plate 22 was swung from position J to H of FIG. 7, the airflow was reduced along the curves I, II and III of FIG. 8 from points X, Y and Z to zero-airflow rate points U, V and W. It will be understood that the heat exchanger of this invention permits to control the airflow over a wide range.

Figure 10:
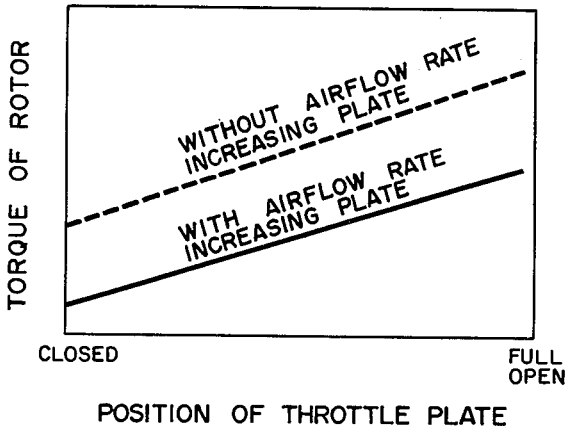

It is known that, in operation of a fan of this type, the torque of motor 6 reduces as the airflow is reduced by operating the throttle plate 22. The mechanism is advantageous in that the rotor driving power decreases as shown in FIG. 10 as the throttle plate 22 is increasingly swung up under conditions when the airflow rate increasing plate 21 is set in a high airflow rate position.

As mentioned previously, one working fluid which undergoes a heat exchange by the rotation of rotor 6 is forced to flow by the pumping action of fluid propelling blade 11 and guide 13 arranged at the axial opposite ends of rotor 6. The fluid passes through the stationary pipe 10 and pumping chamber 7 into the distribution-suction passage 18A, and thence the fluid is evenly distributed into a plurality of annular passages 17A with a low flow resistance. The fluid which has efficiently passed through the annular passages 17A is then concentrated into the concentration-delivery passage 19A and thence delivered at a high efficiency by way of the pumping chamber 8 and stationary pipe 12. Whereas, the other fluid flows diametrically through the rotor 6 at a high efficiency thereby efficiently exchange heat with the air constantly flowing through the spaces defined between the outer wall surfaces of said plurality of annular passage members 17 and a plurality of air-blowing blades 16 connected to said annular passage members 17. Besides, such a heat exchange operation can be controlled effectively and precisely by adjusting the position of airflow rate increasing plate 21 and throttle plate 22.

According to the construction of this invention, the heat exchange is mostly performed in heat transmitting surfaces of the air-blowing blades 16 of rotor 6. The air-blowing blades 16 also serve as heat transfer fins. Generally, the air-blowing blades 16 have a very wide total surface area and, therefore, the heat exchanger of this invention may be dispensed with any additional heat transfer fins if the air-blowing blades 16 and various passage members is made of such a material as Cu, Al or brass having a high heat transfer rate. In contrast with conventional rotary type heat exchangers which are provided with fins acting exclusively as heat radiating means, the heat exchanger of this invention involves no danger that the efficiency thereof is reduced due to boundary layers formed by the fins.

Figure 11:
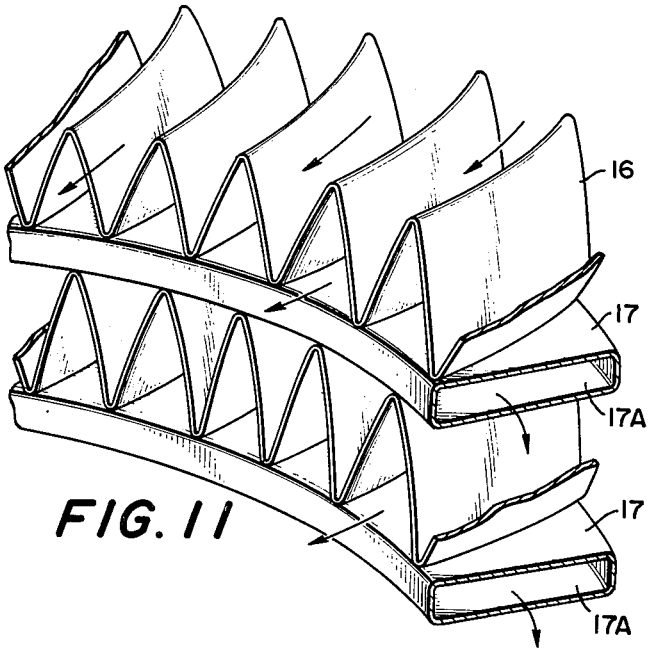
FIGS. 11 and 12*a* are fragmented perspective views of the air-blowing blades and FIG. 12*b* is a view for explaining the arrangement of baffle segments on the air-blowing blades.
Figure 12A:
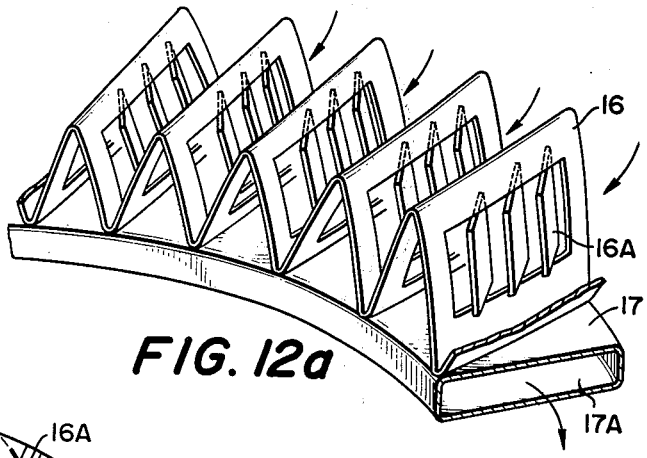
Figure 12B:
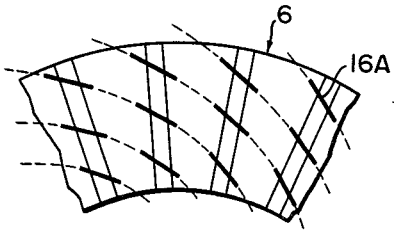

Some of the conventional heat exchangers of this type are provided with blades having inner spaces for flowing the fluid. Compared with this, the air-blowing blades 16 of this invention can be manufactured more easily at an extremely low cost. Illustrated in FIGS. 11 and 12 are preferred embodiments of such air-blowing blades 16. The blade 16 of FIG. 11 is made by corrugating a long strip of plate so that each of the V shaped blades are inwardly curved to the direction of rotation of the rotor 6. Illustrated in FIG. 12a is another embodiment of the blade 16 which is made by corrugating a long strip of plate to form V shaped cross section by cutting and bending the predetermined parts in its plane portion so that said bent parts are curved inwardly in the direction of rotation of said rotor. These baffle segments (bent parts) 16A are arranged along arcuated or suitably curved lines extending along the direction of rotation as shown in FIG. 12*b*. This type of air-blowing blades 16 may be manufactured easily by use of the production technique for the louver fin employed in a conventional automobile radiator. Besides, the blade wheel 6 has a self-cleaning effect that dusts and foreign matters accumulated between the air-blowing blades 16 on the suction side of casing are carried away out of the delivery side by the first working fluid flowing in a direction perpendicular to the axis of rotor 6 through the air-blowing blades 16.

Figure 13:
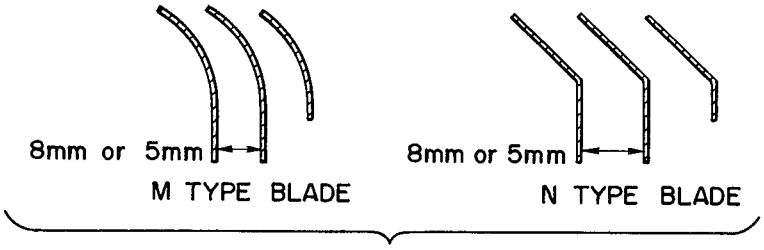
FIG. 13 is a schematic view representing configurations of the air-blowing blades.
Figure 14:
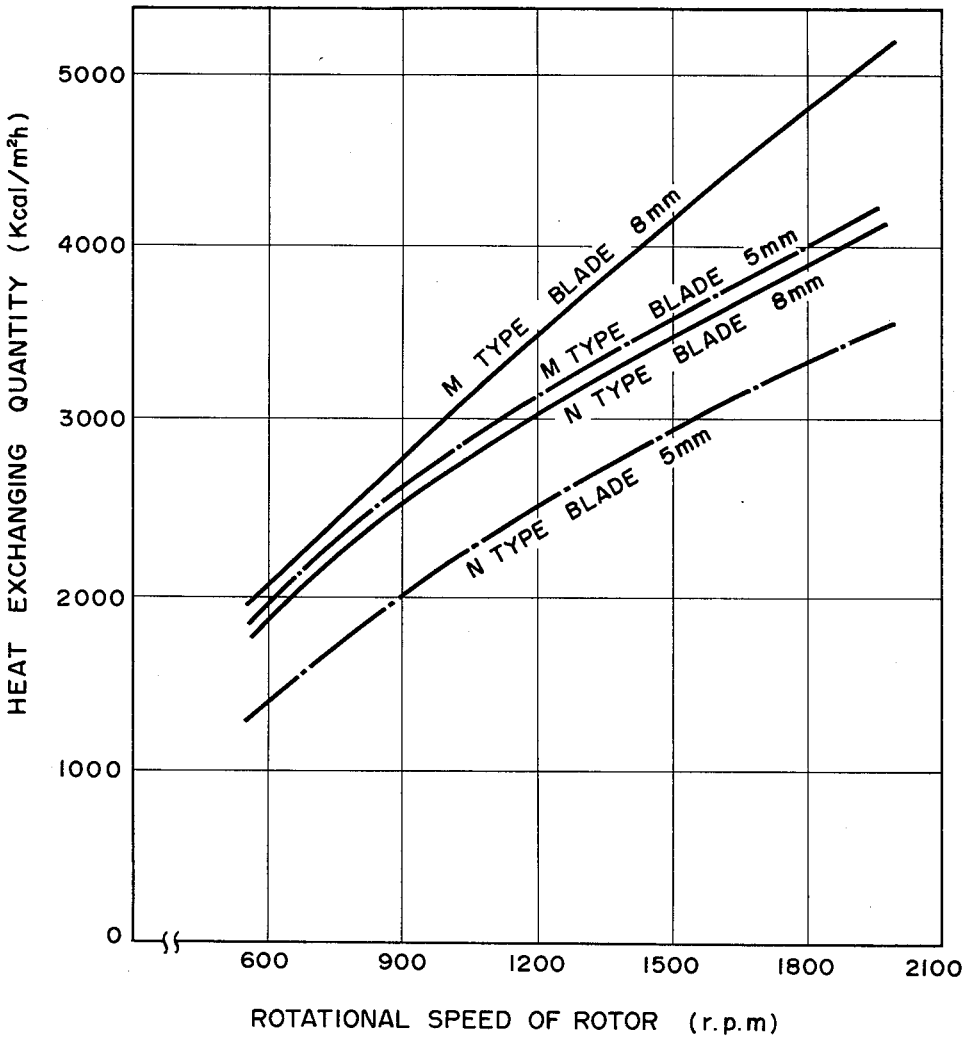
FIG. 14 is a graph representing the characteristic curves obtained from the heat exchanger of FIG. 1.

Represented in FIG. 14 are results of experiments which were carried out for four different heat exchangers of this invention having following specifications:

Outer diameter of rotor: 145 mm
Inner diameter of rotor: 110 mm
Axial length of rotor: 100 mm
Cross sectional area of distribution-suction passage member and concentration-delivery passage member: 20 mm × 20 mm
Number of annular passage: 10
Cross sectional area of annular passage: 4 mm × 15 mm
Configuration of air-blowing blade: two-types (see FIG. 13, M, N)
Spacing between to adjacent air-blowing blades: 5 mm and 8 mm In the graph of FIG. 14 the speed of revolution of rotor is taken on the abscissa and the heat exchanging quantity is taken on the ordinate. In the experiments, the four heat exchangers were provided with such a combination of casings 1 and 2 as shown in FIG. 6. Also, the water of 80° C was introduced into the rotor 6 at a rate of 5 l/min and the inlet temperature of the air flowing diametrically through the rotor was maintained at 20° C.

The construction and operation of the heat exchanger according to this invention will be apparent from the foregoing description. It should be noted, however, that the invention is not limited only to the shown and described embodiments. For example, although the rotor 6 has been described as to have annular fluid passages, a spiral hollow fluid passage may also be used. Furthermore, a plurality of distribution-suction passages and a plurality of concentration-delivery passages may be arranged in the rotor. These and other alterations and modifications may be done without departing from the spirit of this invention.

The invention has been described hereinabove with respect to a heat exchanger which is operative to transfer heat between gases, liquids, fluid powders or combinations of these materials. The heat exchanger of this invention may be used also as a liquid or gas heating device by using a heated liquid or other material as a heat source, as a cooling machine by utilizing the change in state of circulating coolant to develop a heat absorbing action, as a thermostatic apparatus for maintaining a first or second working fluid at a constant temperature and also as a drying apparatus. The heat exchanger of this invention may also be applied to a radiator or oil cooler rotating with the output shaft of a reciprocal or rotary engine. It may be also used as a condenser for a steam engine, oil cooler for machine tools or other industrial machines and compressor and moisture controller for an air conditioning system. It will now be apparent that the heat exchanger of this invention has a very wide application in various industrial fields.

We claim:

1. A heat exchanger having a rotor for generating a stream of a first working fluid and for effecting a heat exchange between said first working fluid being drawn across the exterior surfaces of the rotor and a second working fluid flowing within said rotor, said rotor being rotatably supported in said stream of first working fluid and comprising:

a plurality of hollow annular passage means coaxially disposed in planes extending perpendicularly to the rotor axis and spaced in predetermined intervals therealong, said hollow annular passage means for containing said second working fluid during heat exchange;

a plurality of solid plates secured between said annular passage means and positioned coaxially with respect to said rotor to form plate surfaces extending parallel to the longitudinal axis of the rotor in order to generate said stream of said first working fluid and to provide a principal means for said heat exchange between said first and second working fluids;

at least one distribution-suction passage means having a first opening at one end thereof and at least one concentration-delivery passage means having a second opening at one end thereof, said distribution-suction and concentration delivery passage means being secured to said annular passage means and positioned oppositely to each other with respect to the longitudinal axis of said rotor and substantially parallel with said axis, and being intercommunicated with said hollow annular passage means for forming a system of internal ducts in said rotor; and port means connected to said openings of said distribution-suction passage means and concentration-delivery passage means for sucking said second working fluid thereinto and delivering said second working fluid therefrom through each of said openings thereof so that said second working fluid is sucked into said distribution-suction passage means through said port means and flows through said plurality of hollow annular passage means, said concentration delivery passage means and said port means, and so that the heat exchange between the stream of said first working fluid, which stream is generated by said plurality of plates, and said second working fluid is accomplished by said plurality of solid plates.

2. A heat exchanger according to claim 1 further comprising:

a casing of predetermined shape having a suction opening and a delivery opening which is disposed with respect to said rotor so as to surround said rotor therein.

3. A heat exchanger according to claim 2, further comprising;

pumping chamber means having predetermined volume disposed in said rotor and connected to said openings of said distribution-suction passage means and concentration-delivery passage means and said port means.

4. A heat exchanger according to claim 3, wherein said pumping chamber means comprises first and second pumping chambers disposed at opposite ends of said rotor in the longitudinal direction thereof.

5. A heat exchanger according to claim 3, wherein said pumping chamber means comprises first and second pumping chambers disposed at the same end of said rotor in the longitudinal direction.

6. A heat exchanger according to claim 4, further comprising:

a suction-distribution member provided coaxially with said rotor in said first pumping chamber and communicating with said first opening of said distribution-suction passage means for flowing said second working fluid from said port means into said first pumping chamber in the radial direction perpendicular to the axis of the rotor.

7. A heat exchanger according to claim 4, further comprising:

a stationary outlet quide passage member disposed coaxially with said rotor within said second pumping chamber and communicating with said second opening of said concentration-delivery passage means for flowing said second working fluid from said second pumping chamber into said port means in the radial direction perpendicular to the axis of the rotor.

8. A heat exchanger according to claim 4, further comprising:

a fluid propelling member having a plurality of blades which is integrally formed into said rotor and is disposed coaxially with said rotor within said first pumping chamber so that said another working fluid is forced to flow from said suction-distribution passage means to said first pumping chamber by the pumping action of said fluid propelling member.

9. A heat exchanger according to claim 2, wherein said casing has a fluid flow rate increasing plate which is pivotably supported at a portion near said suction opening outside said casing, thereby to control fluid flow rate of said first working fluid cross-flowing through said rotor.

10. A heat exchanger according to claim 2, wherein said casing has a throttle plate which is pivotably supported at a portion near said delivery opening inside said casing, thereby to control fluid flow rate of said first working fluid in said casing.

11. A heat exchanger according to claim 6, further comprising:

a stationary outlet guide passage member disposed coaxially with said rotor within said second pumping chamber communicating with said second opening of said concentration-delivery passage means for flowing said second working fluid from said second pumping chamber into said port means in the radial direction perpendicular to the axis of the rotor.

12. A heat exchanger according to claim 11, further comprising:

a fluid propelling member having a plurality of blades which is integrally formed into said rotor and is disposed coaxially with said rotor within said first pumping chamber so that said second working fluid is forced to flow from said suction-distribution passage means to said first pumping chamber by the pumping action of said fluid propelling member.

13. A heat exchanger according to claim 4, further comprising:

a suction-distribution member provided coaxially with said rotor in said first pumping chamber connected to said first opening of said distribution-suction passage means for flowing said second fluid from said port means into said first pumping chamber in the radial direction perpendicular to the axis of the rotor, a stationary outlet guide passage member disposed coaxially with said rotor within second pumping chamber communicating with said second opening of said concentration-delivery passage means for flowing said second working fluid from said second pumping chamber into said port means along a radial direction perpendicular to the axis of the rotor, and a fluid propelling member having a plurality of blades which is integrally formed into said rotor and is disposed coaxially with said rotor within said first pumping chamber so that said second working fluid is forced to flow from said suction-distribution passage means to said first pumping chamber by the pumping action of said fluid propelling member.

14. A heat exchanger according to claim 5, further comprising:

(a) a suction-distribution member provided coaxially with said rotor in said first pumping chamber connected to said first opening of said distribution-suction passage means for flowing said another working fluid from said port means into said first pumping chamber in the radial direction perpendicular to the axis of the rotor;

(b) a stationary outlet guide passage member disposed coaxially with said rotor within said second pumping chamber connected to said second opening of said concentration-delivery passage means for flowing said another working fluid from said second pumping chamber into said port means in the radial direction perpendicular to the axis of the rotor; and (c) a fluid propelling member having a plurality of blades which is integrally formed into said rotor and is disposed coaxially with said rotor within said first pumping chamber so that said another working fluid is forced to flow from said suction-distribution passage means to said first pumping chamber by the pumping action of said fluid propelling member.

15. A heat exchanger according to claim 13, wherein said plurality of solid blades are a plurality of plates each having an arc cross section inwardly curved in the direction of rotation of said rotor.

16. A heat exchanger according to claim 13 wherein said blades are made by corrugating a long strip type of plate having a predetermined width so that each blades have V-shaped cross section and are inwardly curved in the direction of rotation of said rotor.

17. A heat exchanger according to claim 13, wherein said blades are made by corrugating a long strip of plate having a predetermined width to form V-shaped cross section and are cut and bent the predetermined parts in the plane portion thereof so that said bent parts are curved inwardly in the direction of rotation of said rotor.

18. A heat exchanger according to claim 13, wherein said stationary outlet guide passage member comprises a circular member having one arc shaped passage having an opening at each of both ends thereof, a first one of said openings thereof being tangentially formed in the outer periphery of said circular member and a second one of said openings having a circular shape and being formed in the central portion of said circular member, the width of said arc shaped passage gradually increasing from said first opening to said second opening, thereby tangentially introducing said second fluid into the arc shaped passage through said first opening thereof from said second opening of said concentration-delivery passage means, and axially delivering said second fluid to said second opening.

19. A heat exchanger according to claim 13, wherein said stationary outlet guide passage member comprises a circular member having a plurality of arc shaped passages disposed at the same interval therein and each passages having two openings one at each end thereof, a first one of said two openings thereof being tangentially formed in the outer periphery of said circular member and a common second opening being formed and concentrated in the central portion of said circular member, and the width of said arc shaped passages gradually increasing from said first opening to said second opening, thereby tangentially introducing said second fluid through each first openings thereof into the arc shaped passages from said second opening of said concentration-delivery passage means, and axially delivering said second fluid to said common second opening.

20. A heat exchanger according to claim 13, wherein said stationary outlet guide passage member comprises a circular member comprising two circular plates and a plurality of a long strip of a curved plate perpendicularly secured to said two circular plates with the both ends of the width of said curved plates so as to form arc shaped passages between said curved plates, each one of said arc shaped passages having one opening tangentially formed in the outer periphery thereof and another common opening provided in the central portion on one of said circular plates and the width thereof gradually increasing from said tangential opening to said common central opening, thereby tangentially introducing said second fluid through each tangential openings thereof into the arc shaped passages from said second opening of said concentration-delivery passage means, and axially delivering said second fluid to said common central opening.

21. A heat exchanger according to claim 15, wherein said stationary outlet guide passage member comprises a circular member having a plurality of arc shaped passages disposed at the same interval therein and each passages having two openings, one at each end thereof, a first one of said two openings thereof being tangentially formed in the outer periphery of said circular member and a second one of said openings being formed and concentrated in the central portion of said circular member, and the width of said arc shaped passages gradually increasing from said first opening to said second opening, thereby tangentially introducing said second fluid through each first openings thereof into the arc shaped passages from said second opening of said concentration-delivery passage means, and axially delivering said second fluid to said second central openings.

22. A heat exchanger according to claim 21, wherein said casing has a fluid flow rate increasing plate which is pivotably supported at a portion near said suction opening outside said casing and overlaps said portion of near said suction opening thereby to control fluid flow rate of said first working fluid cross-flowing through said rotor.

23. A heat exchanger according to claim 21, wherein said casing has a throttle plate which is pivotably supported at a portion near said delivery opening inside said casing thereby to control fluid flow rate of said first working fluid in said casing.

24. A heat exchanger according to claim 22, wherein said casing further has a throttle plate which is pivotably supported at a portion near said delivery port inside said casing, thereby to control fluid flow rate of said first working fluid in said casing.

25. A heat exchanger according to claim 19, wherein said casing has a fluid flow rate increasing plate which is pivotably supported at a portion near said suction opening outside said casing and which overlaps said portion of said casing and a throttle plate which is pivotably supported at a portion near said delivery opening inside said casing, thereby to control fluid flow rate of said first working fluid cross-flowing said rotor, and to control fluid flow rate of said first working fluid in said casing.

26. A heat exchanger according to claim 25, wherein said casing comprises a first member formed into the spiral, logarithmic shape and a second member formed into the S-shape to form said suction opening and delivery opening between said first and second members, said rotor is composed of a cylindrical body supported at both ends of hollow cylindrical member on a bearing means fixed to the base member, said hollow annular passage means have a rectangular cross section, said distribution-suction passage means comprises a hollow rectangular member having an open end as said first opening and a closed end, said distribution-suction passage means having a larger cross section than that of said hollow annular passage means, said concentration-delivery passage means comprises a hollow rectangular member having a closed end and an open end as said second opening, said concentration-delivery passage means having a larger cross section than that of said hollow annular passage means, and oppositely positioned to said distribution-suction passage means with respect to the longitudinal axis of said rotor, said first and second pumping chambers are disposed at both ends of the rotor, are respectively formed by two circular plates and a side peripheral plate, one circular plate of said first pumping chamber having an opening communicating with said first opening of said distribution-suction passage means, and another circular plate having a central opening communicating with a circular opening of one end of a first hollow cylindrical member, one circular plate of said second pumping chamber having an opening communicating with said second opening of said concentration-delivery passage means, and another circular plate having a central opening communicating with a circular opening of a second hollow cylindrical member.

27. A heat exchanger according to claim 26, wherein said blades are shaped into a long strip of plate curved inwardly in the direction of rotation of said rotor forming a blade surface having a normal at each point perpendicular to said longitudinal axis of said rotor.

28. A heat exchanger according to claim 26, wherein said blades are made by corrugating a long strip type of plate having a predetermined width so that each blades have V-shaped cross section and are inwardly curved in the direction of rotation of said rotor.

29. A heat exchanger according to claim 26, wherein said blades are made by corrugating a long strip of plate having a predetermined width to form V-shaped cross section and are cut and bent the predetermined parts in the plane portion thereto, so that said bent parts are curved inwardly in the direction of rotation of said rotor.

30. A heat exchanger according to claim 14, wherein said casing comprises one member formed into the spiral shape due to the logarithmic function and another member formed into the S-shape to form said suction opening and delivery opening between said one and another members, said rotor is composed of a cylindrical body supported at end of hollow cylindrical member and a cylindrical member on a bearing means fixed to the base member and driven by driving a belt-pulley fixed to the end of hollow cylindrical member by a driving device through belt means, said blades are composed of a plurality of plates having an arc cross section inwardly curved in the direction of rotation of said rotor, said hollow annular passage means have a rectangular cross section, said blades are composed of a long strip of plate curved inwardly in the direction of rotation of said rotor, said distribution-suction passage means comprises a hollow rectangular member having an open end as said first opening and a closed end which has a larger chamber than that of said hollow annular passage means, said concentration-delivery passage means comprises a hollow rectangular member having a closed end and an open end positioned at the common end to said open end of said distribution-suction passage means as said second opening, which has a larger chamber than that of said hollow annular passage means, and positioned opposite to said distribution-suction passage means with respect to the axis of said rotor, said first and second pumping chamber are disposed at the common end of the rotor, said first chamber being formed by a circular plate disposed at one end of said rotor having an opening connected to said first opening of said distribution-suction passage means, a first annular plate opposite to said circular plate having a central opening connected to said circular opening of said end hollow cylindrical member and a peripheral side plate, and said second chamber being formed by said first annular plate and a second annular plate which has a central larger opening than that of said first annular plate, connected to an annular opening of said delivery port means and has a rectangular opening connected to said rectangular opening of said concentration-delivery passage means, penetrating said first chamber without leakage.

31. A heat exchanger having a rotor for generating a stream of a first working fluid and for effecting a heat exchange between said first working fluid passing through said rotor and a second working fluid, said rotor being rotatably supported in said stream of first working fluid and comprising:

a plurality of hollow annular passage means for containing said second working fluid, said annular passage means coaxially disposed in planes extending perpendicularly to the rotor axis and spaced in predetermined intervals therealong;

a plurality of blades comprising thin plate members and operating as a fan and fin to exchange heat between said first working fluid and said second working fluid contained within said annular passage means, said blades secured and thermally coupled to said annular passage means and positioned coaxially with respect to said rotor to form a blade surface extending parallel to the longitudinal axis of the rotor;

a single distribution-suction passage means having a first opening at one end thereof and a single concentration-delivery passage means having a second opening at one end thereof, said distribution-suction passage means and concentration-delivery passage means being secured to said annular passage means and positioned in an opposing relation to each other with respect to the axis of said rotor, and intercommunicating with said hollow annular passage means to form a system of internal ducts in said rotor so that each portion of said second working fluid flowing through said heat exchanger travels through a path of equal length regardless of which one of said plurality of hollow annular passage means said portion of said second fluid flows through, said second working fluid flowing from a port means to said distribution-suction passage means through said plurality of hollow annular passage means to said concentration-delivery passage means, and then to said port means communicated by said openings with said distribution-suction passage means and concentration-delivery passage means, said port means and distribution-suction means for sucking said second working fluid into said annular passage means, and said port means and concentration-delivery means for delivering said second working fluid from said annular passage means, said blades impelling said first working fluid by fan-like operation and exchanging heat between said first working fluid and second working fluid by fin-like operation.

32. In a heat exchanger, a rotor having an inlet and outlet port, generating a stream of air through said rotor and exchanging heat between said fluid and air flowing through said rotor, said rotor comprising:

a single distribution-suction passage communicating with said inlet port, said distribution-suction passage generally aligned along the longitudinal axis of said rotor, said fluid flowing from said inlet port through said distribution-suction passage;

a plurality of annular, hollow ring passages, each generally disposed on a plane perpendicular to said longitudinal axis of said rotor, each of said annular, hollow ring passages communicating with said distribution-suction passage at a first position on each annular, hollow ring passage, said fluid flowing through said distribution-suction passage into each of said annular, hollow ring passages;

a plurality of solid thin arced plates coupled between each of said annular hollow ring passages and having surfaces generally parallel to said longitudinal axis, said solid thin arced plates collectively operating as a fan to generate said stream of air through said rotor as said rotor is rotated, and each operating as a fin thermally coupled to said annular, hollow ring passages so that heat is withdrawn from said fluid within said annular, hollow ring passages, coupled to said plurality of solid thin arced plates and transferred to said stream of air; and a single concentration-delivery passage communicating with each of said plurality of annular, hollow ring passages at a second position, said second position being diametrically opposed to said first position with respect to said longitudinal axis of said rotor, said fluid flowing from said plurality of annular, hollow ring passages to said concentration-delivery passage and thence to said outlet port.

* * * * *